US011927079B2

(12) United States Patent
Penno et al.

(10) Patent No.: US 11,927,079 B2
(45) Date of Patent: Mar. 12, 2024

(54) GRAVEL PACK SYSTEMS, METHODS TO FLOW FLUID OUT OF A GRAVEL PACK SYSTEM, AND METHODS TO PROVIDE FLUID FLOW DURING A GRAVEL PACKING OPERATION

(71) Applicant: Halliburton Energy Services, Inc., Houston, TX (US)

(72) Inventors: Andrew D. Penno, Singapore (SG); Kevin Albert Graham Ross, Carrollton, TX (US); Maxime P. Coffin, Dubai (AE)

(73) Assignee: Halliburton Energy Services, Inc., Houston, TX (US)

( * ) Notice: Subject to any disclaimer, the term of this patent is extended or adjusted under 35 U.S.C. 154(b) by 125 days.

(21) Appl. No.: 17/587,990

(22) Filed: Jan. 28, 2022

(65) Prior Publication Data

US 2023/0243243 A1 Aug. 3, 2023

(51) Int. Cl.
*E21B 43/04* (2006.01)

(52) U.S. Cl.
CPC ..... *E21B 43/04* (2013.01)

(58) Field of Classification Search
CPC ..... E21B 43/04; C09K 8/34
USPC ..... 166/278
See application file for complete search history.

(56) References Cited

U.S. PATENT DOCUMENTS

| | | | | |
|---|---|---|---|---|
| 8,011,433 | B2 | 9/2011 | Chay et al. | |
| 2008/0314589 | A1* | 12/2008 | Guignard | E21B 43/04 166/278 |
| 2011/0139465 | A1* | 6/2011 | Tibbles | E21B 34/063 166/387 |
| 2014/0251609 | A1* | 9/2014 | Broussard | E21B 34/102 166/278 |
| 2020/0131891 | A1* | 4/2020 | Least | E21B 43/02 |
| 2021/0348478 | A1* | 11/2021 | Novelen | E21B 43/08 |

OTHER PUBLICATIONS

International Search Report and Written Opinion dated Oct. 21, 2022 in PCT/US2022/016875 (11 pages).

* cited by examiner

*Primary Examiner* — William D Hutton, Jr.
*Assistant Examiner* — Ashish K Varma
(74) *Attorney, Agent, or Firm* — Barnes & Thornburg, LLP

(57) ABSTRACT

A gravel pack system has a heel section and a toe section that is downhole from the heel section. The system also includes a conveyance having an interior passageway for fluid flow to the toe section, a closing sleeve that forms an annulus with the conveyance, a shunt having a first section that provides a fluid flow entrance into the shunt, a second section that extends to the heel section along the gravel pack system, and one or more nozzles along the second section that provides fluid flow out of the gravel pack system at the heel section, and a shroud having a first section that is coupled to the closing sleeve and a second section that is coupled to the shunt, where the shroud and the conveyance form a second annulus.

20 Claims, 5 Drawing Sheets

GRAVEL PACK SYSTEMS, METHODS TO FLOW FLUID OUT OF A GRAVEL PACK SYSTEM, AND METHODS TO PROVIDE FLUID FLOW DURING A GRAVEL PACKING OPERATION

BACKGROUND

The present disclosure relates generally to gravel pack systems, methods to flow fluid out of a gravel pack system, and methods to provide fluid flow during a gravel packing operation.

A gravel packing operation is sometimes performed prior to commencement of a hydrocarbon production operation to reduce the amount of unwanted formation sand that may flow into downhole strings (such as production strings) that are deployed in a wellbore during the hydrocarbon production operation. During a gravel packing operation, a fluid containing a sand/proppant slurry is pumped into a production zone of the wellbore. After the sand/proppant slurry is pumped into the production zone, the sand/proppant slurry is dehydrated to form gravel packs around future production regions and to inhibit sand flow into the downhole strings.

BRIEF DESCRIPTION OF THE DRAWINGS

Illustrative embodiments of the present disclosure are described in detail below with reference to the attached drawing figures, which are incorporated by reference herein, and wherein.

Figure 1:
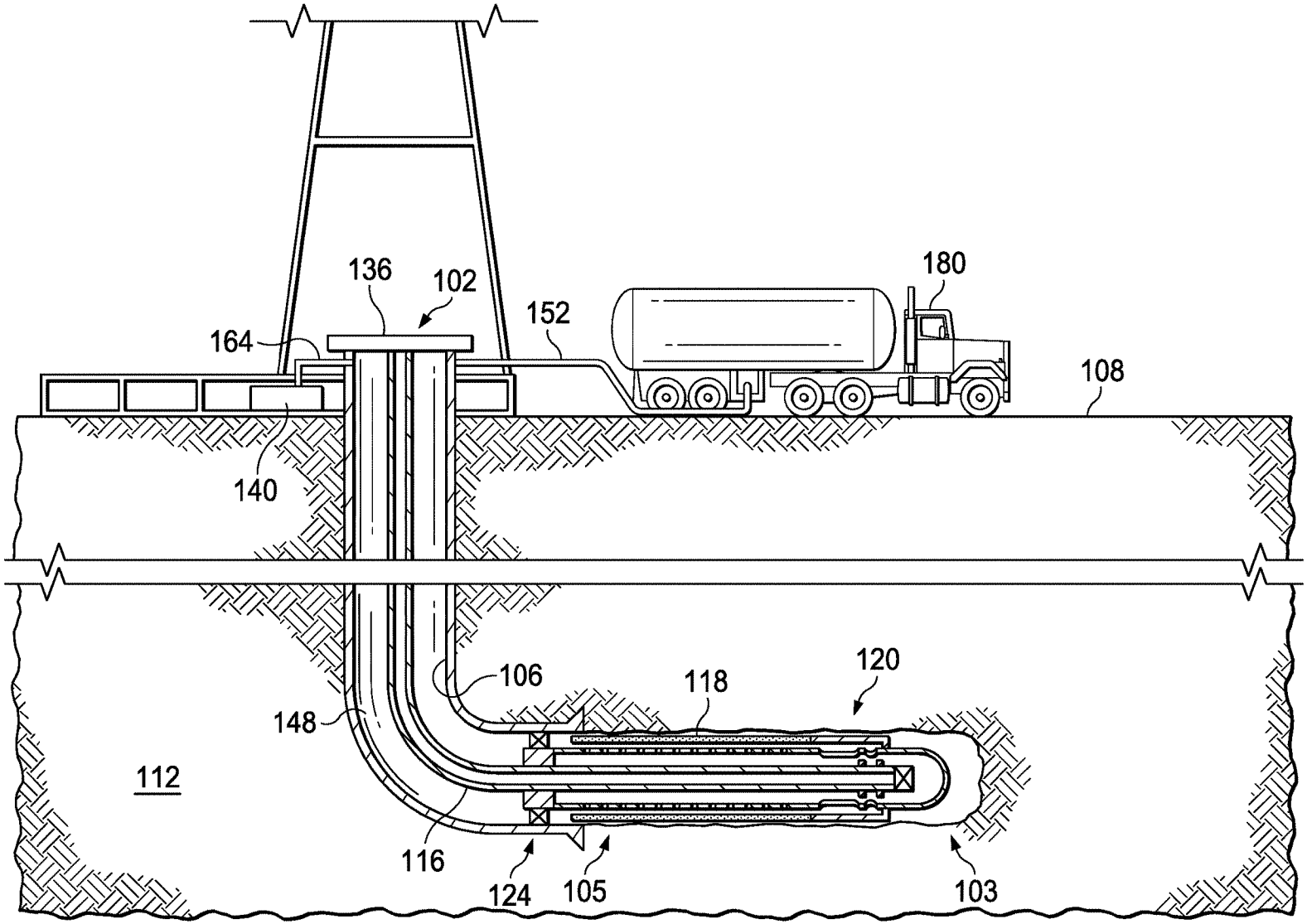
FIG. 1 is a schematic, side view of a wellbore during a gravel packing operation.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to gravel pack systems, methods to flow fluid out of a gravel pack system, and methods to provide fluid flow during a gravel packing operation. The gravel pack system includes a downhole string that runs into a wellbore of a hydrocarbon well, through a heel section of the gravel pack system, and to or through a toe section of the gravel pack system that is downhole from the heel section. As referred to herein, a downhole string refers to any type of string or conduit that has an interior passageway (such as an annulus) for fluid flow to or towards the toe section of the gravel pack system. In some embodiments, where the downhole string is coupled to a tool, fluid flow through the interior passageway of the downhole string, and through the tool and out of the tool, where the fluid flows into the toe section of the gravel pack system.

The gravel pack system has a closing sleeve that is positioned around a section (first section) of the downhole string. Moreover, the closing sleeve has or forms an annulus (first annulus) that provides a fluid passageway (first fluid passageway) from the toe section towards the heel section. As referred to herein, a closing sleeve is any sleeve that is configured to be in a first position such as an open position when the gravel back system is run downhole, and is configured to shift to a second position such as a closed position after a desired well operation such as a gravel packing operation is performed. In some embodiments, the positioning of the closing sleeve with respect to the first section of the downhole string forms the first annulus between the closing sleeve and the downhole string. In some embodiments, the closing sleeve is a multi-positioning closing sleeve. In some embodiments, the closing sleeve has a seal bore that is positioned around the downhole string. In one or more of such embodiments, one or more seals are positioned between the seal bore and the downhole string to form a fluid seal that prevents fluid flow between the downhole string and the seal bore. In some embodiments, the seal bore of the closing sleeve is positioned between a shroud and the downhole string. In some embodiments, the gravel pack system has a port that is positioned between the downhole string and the closing sleeve that provides a fluid passageway from the downhole string into the first annulus.

The gravel pack system also has a shunt that is positioned around a section (second section) of the downhole string that is uphole from the closing sleeve. The shunt has a first section that provides a fluid flow entrance into the shunt, a second section that extends to the heel section, and one or more nozzles positioned along the second section that provide a fluid flow out of the gravel pack system at various locations along the second section. In some embodiments, the first section of the shunt forms an entrance joint or is coupled to an entrance joint, and the second section of the shunt forms an exit joint or is coupled to an exit joint. In some embodiments, the gravel pack system also has a flow control device that is fluidly coupled to a nozzle and configured to control fluid flow out of the nozzle. As used herein, the flow control device may refer to an inflow control device (ICD), an autonomous inflow control device (AICD), an adjustable inflow control device (adjustable ICD), or another type of tubular or device that controls fluid flow. In some embodiments, the gravel pack system also has a screen positioned at or near the second section to filter out materials having dimensions greater than a threshold dimension from entering into the screens. Moreover, after completion of a gravel packing operation, the screen also prevents gravel pack sand or proppant having dimensions greater than the threshold dimension from flowing back into the screen joints.

The gravel pack system also has a shroud having a first section that is coupled to the closing sleeve, and a second section that is coupled to the first section (e.g., the entrance joint) of the shunt. The shroud is positioned around a section (third section) of the downhole string that is between the closing sleeve and the shunt to form an annulus (second annulus) between the closing sleeve and the downhole string that provides a fluid passageway (second fluid passageway) from the toe section towards the heel section. In some embodiments, the shroud is not perforated, and is formed from a non-permeable material to prevent fluids from flowing through the second annulus to flow out of the wall of the shroud. In some embodiments, the gravel pack system also has one or more sealing elements such as o-rings that are positioned between the first section of the shroud and the closing sleeve that form a fluid seal to prevent fluid flow between the first section of the shroud and the closing sleeve. In one or more of such embodiments, an interface of the first section of the shroud and a corresponding interface of the closing sleeve engage each other to form a rachet or another mechanism that engages or couples the first section of the shroud to the closing shroud. In one or more of such embodiments, the interfaces have gear, teeth, or other types of profiles that engage each other to couple the first section of the shroud to the closing shroud.

After the gravel pack system is run downhole and is positioned at a desired location, fluid such as gravel slurry flows downhole through the interior passageway of the downhole string into the toe section. The fluid then flows through the first fluid passageway into the shroud, through the second fluid passageway through the shroud into the first section of the shunt, from the first section of the shunt through the shunt out the one or more shunt nozzles, and into the wellbore. The configurations described herein of flowing fluid, such as a proppant slurry into a toe section of the gravel pack system, and through interior passageways formed from shrouds and other components of the gravel pack system to a heel section of the wellbore, and flowing the fluid out of the heel section of the gravel pack system into the wellbore and formation with reduced friction pressure induced through the wash pipe while pumping compared to a conventional heel to toe mode. Additional descriptions of gravel back systems, methods to flow fluid out of a gravel pack system, and methods to provide fluid flow during a gravel packing operation are described in the paragraphs below and are illustrated in FIGS. 1-5.

Turning now to the figures, FIG. 1 is a schematic, side view of a well 102 during a gravel packing operation. In the embodiment of FIG. 1, well 102 has a wellbore 106 that extends from a surface 108 of the well 102 to or through a formation 112. A string 116, along with a gravel pack system 120, are lowered down wellbore 106, i.e. downhole. In one or more embodiments, string 116, or portions of string 116 may be coiled tubing, drill pipe, production tubing, or another type of string operable to deploy gravel pack system 120. Although not illustrated, string 116 may include various tubular types and downhole tools (e.g., screens, valves, isolation devices etc.) used to perform a variety of downhole operations. In the embodiment of FIG. 1, at a wellhead 136, an inlet conduit 152 is coupled to a fluid source (vehicle 180) to provide a fluid passageway for fluids, such as proppant slurry, to flow from vehicle 180 to string 116. Moreover, string 116 has an internal cavity that provides an interior passageway for fluids to flow from surface 108 downhole, where the fluids flow out of string 116 and into a toe section 103 of gravel pack system 120. The fluid flows through annuluses within the gravel pack system 120 between string 116 and other components (shown in FIG. 2) of gravel pack system 120 including a shunt and screen 118 towards a heel section 105 of gravel pack system 120 near packers 124. During a gravel packing operation, proppant slurries flow out of heel section 105 of gravel pack system 120 to desired regions along wellbore 106. The slurries are subsequently dehydrated, thereby allowing gravel pack to be formed at the desired regions of wellbore 106.

String 116 also provides a fluid passageway for fluids to flow from wellbore 106 back towards surface 108. In that regard, FIG. 1 illustrates an annulus 148 that provides a conduit for fluids to flow from wellbore 106 up to surface 108 where the fluids exit annulus 148 via an outlet conduit 164, and are captured in container 140. In some embodiments, string 116 includes multiple fluid passageways for flowing different types of fluids downhole and for flowing fluids to surface 108. In some embodiments, annulus 148 is used for flowing fluids downhole and for flowing fluids from a downhole location to surface 108. In some embodiments, string 116 also transmits signals, such as a signal to actuate a piston component of gravel pack system 120. In one or more embodiments, string 116 also provides power to gravel pack system 120 as well as other downhole components. In one or more embodiments, string 116 also provides downhole telemetry.

FIG. 1 illustrates deployment of one gravel pack system 120 along a section of string 116 that runs approximately horizontally across formation 112 (hereafter referred to as the horizontal section of string 116). In some embodiments, gravel packs are installed around gravel pack system 120. In some embodiments, gravel packs are installed throughout the horizontal section of string 116. In some embodiments, multiple gravel pack assemblies (not shown) are coupled to different sections of string 116. Additional descriptions of different embodiments of a gravel pack system are illustrated in FIGS. 2-3B.

Figure 2:
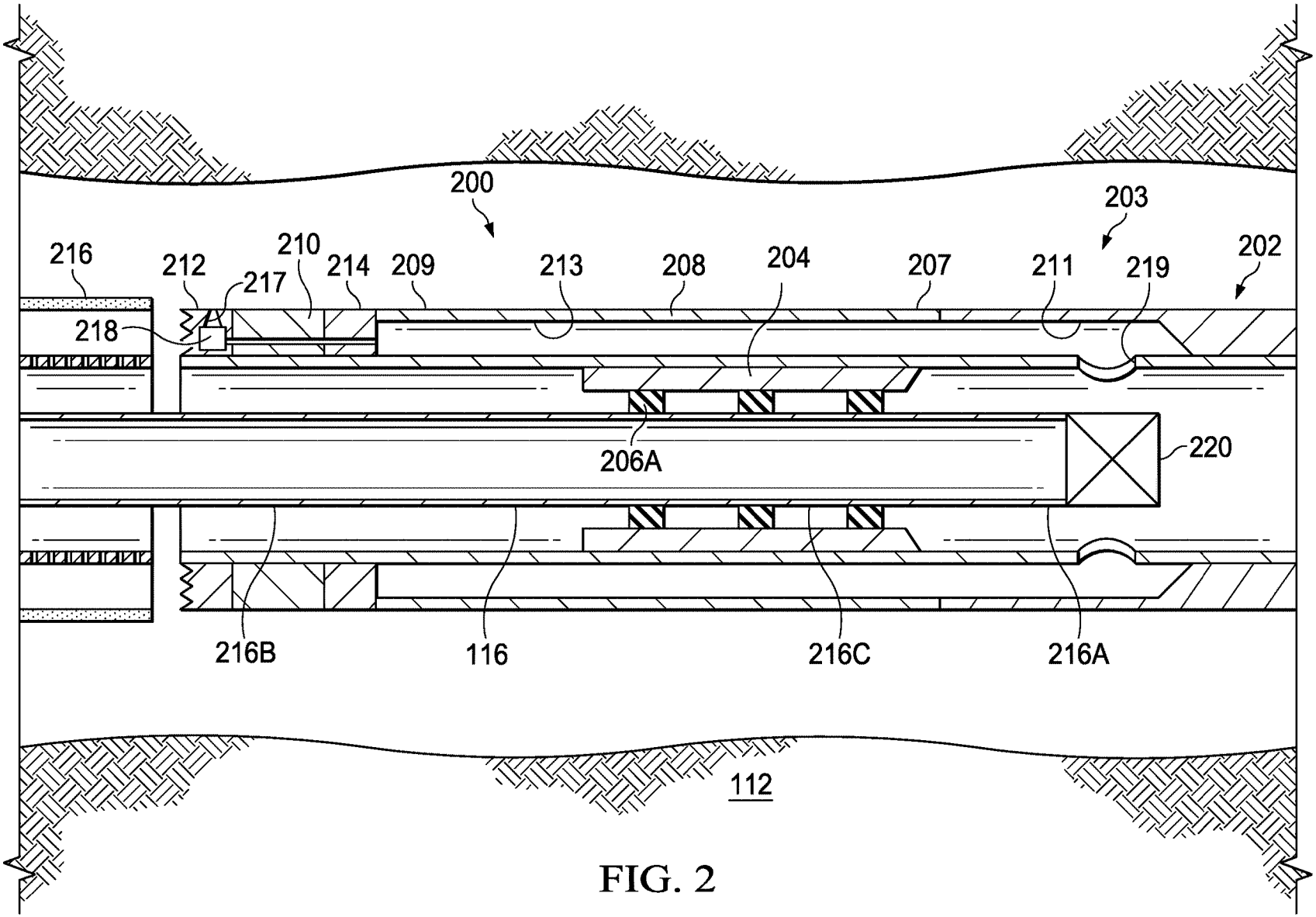
FIG. 2 is a schematic, partial cross-sectional view of a gravel pack system similar to the gravel packing system of FIG. 1 during a gravel packing operation.

In that regard, FIG. 2 is a schematic, partial cross-sectional view of a gravel pack system 200 similar to gravel packing system 120 of FIG. 1 during a gravel packing operation. In the embodiment of FIG. 2, gravel pack system 200 includes a section or the entirety of downhole string 116 that extends from a heel section (such as heel section 105 of FIG. 1) of gravel pack system 200 to a toe section 203 of gravel pack system 200, where toe section 203 is downstream from the heel section. Gravel pack system 200 also has a closing sleeve 202 that is positioned around a first section 216A of downhole string 116. Further, closing sleeve 202 has or forms a first annulus 211 between closing sleeve 202 and downhole string 116 that provides a first fluid passageway from toe section 203 towards the heel section. In the embodiment of FIG. 2, downhole string 116 is coupled to a tool 220 used during gravel packing and/or other well operations. Moreover, fluids flowing through downhole string 116 flow into tool 220, through one or more ports or openings (not shown) of tool 220, and out of tool 220. In the embodiment of FIG. 2, gravel pack system 200 also has a port 219 that is positioned between downhole string 116 and closing sleeve 202 to provide a fluid passageway from downhole string 116 into first annulus 211. Moreover, fluids flowing out of tool 220 flow through port 219 into first annulus 211. Closing sleeve 202 has a seal bore 204 that is positioned around downhole string 116. In the embodiment of FIG. 2, one or more o-rings, including o-ring 206A, are positioned between seal bore 204 and downhole string 116 to form a fluid seal.

Gravel pack system 200 also has a shunt 210 that is positioned around a second section 216B of downhole string 116 that is downstream from closing sleeve 202. Shunt 210 has a first section 214 that provides a fluid flow entrance into shunt 210, a second section 212 that extends to the heel section along gravel pack system 200, and one or more nozzles including nozzle 217 that are positioned along second section 212, where the nozzles provide fluid flow out of gravel pack system 200. In the embodiment of FIG. 2, first section 214 of shunt 210 is an entrance joint having an opening into an interior passageway of shunt 210. A screen 216 of gravel pack system 200 is positioned near second section 212 to filter out materials having dimensions greater than a threshold dimension entering into screen 216. In the embodiment of FIG. 2, screen 216 extends from the position illustrated in FIG. 2 to the heel section to provide a filter from the position illustrated in FIG. 2 to the heel section. Further, gravel pack system 200 includes a flow control device 218 that is configured to control fluid through screen 216. Examples of flow control devices include, but are not limited to, ICDs, AICDs, adjustable ICDs, and other types of tubular or device that control fluid flow.

Gravel pack system 200 also has a non-perforated shroud 208 having a first section 207 that is coupled to closing sleeve 202, and a second section 209 that is coupled to first section 214 of shunt 210. Shroud 208 is positioned around a third section 216C of downhole string 116 that is between closing sleeve 202 and shunt 210 to form a second annulus 213 between closing sleeve 202 and downhole string 116 that provides a second fluid passageway from toe section 203 of gravel pack system 200 towards the heel section of gravel pack system 200.

In the embodiment of FIG. 2, downhole string 116 is coupled to tool 220, and fluids flow through downhole string 116 out of tool 220, through port 219, and into first annulus 211. In some embodiments, where downhole string 116 is not coupled to tool 220, fluids flow out of an opening of downhole string 116 through port 219 and into first annulus 211. In the embodiment of FIG. 2, an end of first section 207 of shroud 208 is coupled to an end of closing sleeve 202. Although FIG. 2 illustrates one flow control device 218, in some embodiments, gravel pack system 200 includes multiple flow control devices 218 configured to control fluid flow through screen 216. Additional descriptions and illustrations of configurations to couple shroud 208 and closing sleeve 202 are provided below and are illustrated in at least FIGS. 3A-3B.

Figure 3A:
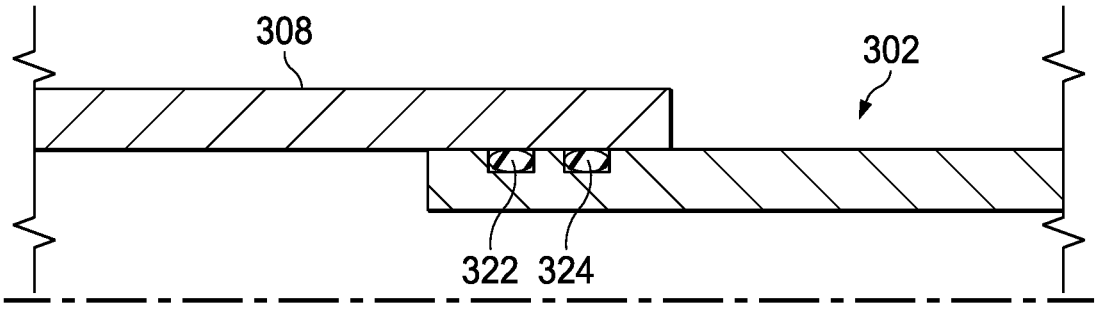
FIG. 3A is a schematic, partial cross-sectional view of a closing sleeve of a gravel pack system similar to the gravel pack system of FIG. 2 coupled to a shroud of the gravel pack system of FIG. 3A.
Figure 3B:
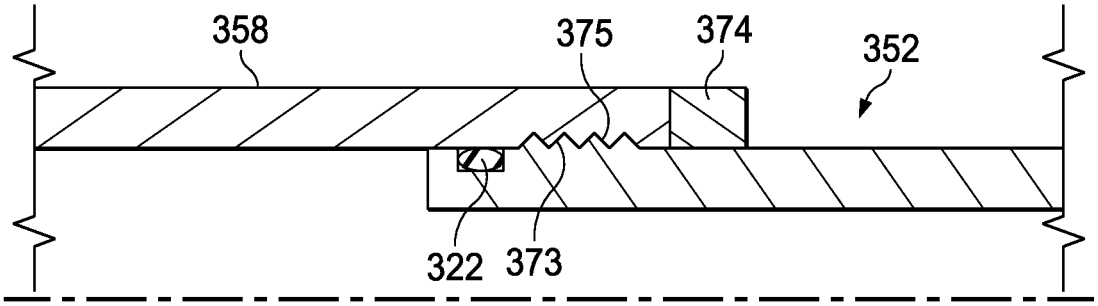
FIG. 3B is a schematic, partial cross-sectional view of a closing sleeve of another gravel pack system similar to the gravel pack system of FIG. 2 and coupled to a shroud of the gravel pack system of FIG. 3B.

In that regard, FIG. 3A is a schematic, partial cross-sectional view of a closing sleeve 302 of a gravel pack system similar to gravel pack system 200 of FIG. 2 coupled to a shroud 308 of the gravel pack system of FIG. 3A. In the embodiment of FIG. 3A, o-rings 322 and 324 are positioned between a section of shroud 308 and closing sleeve 302 to form a fluid seal to prevent fluid flow between the section of the shroud 308 and closing sleeve 302. FIG. 3B is a schematic, partial cross-sectional view of a closing sleeve 352 of another gravel pack system similar to gravel pack system 200 of FIG. 2 and coupled to a shroud 308 of the gravel pack system of FIG. 3B. In the embodiment of FIG. 3B, an o-ring 372 is positioned between a section of shroud 358 and closing sleeve 352 to form a fluid seal to prevent fluid flow between the section of the shroud 358 and closing sleeve 352. Moreover, shroud 308 has a first interface 373 that engages a second corresponding interface 375 of closing sleeve 352 to form a rachet mechanism 374 or another mechanism configured to fixedly engage shroud 358 to closing sleeve 352. In the embodiment of FIG. 3B, first interface 373 and second interface 375 each includes a profile that engages other profiles of the corresponding interface. In some embodiments, first interface 373 and second interface 375 include teeth or other types of profiles that engage other teeth or other types of profiles of the corresponding interface. Although FIGS. 3A and 3B illustrate having two o-rings 322 and 324, and one o-ring 372, respectively, in some embodiments, a different number of o-rings (not shown) are positioned between shroud 308 and closing sleeve 302 to form one or more fluid seals. Further, although FIG. 3B illustrates one rachet mechanism 374 formed by two interfaces 373 and 375, in some embodiments, multiple mechanisms (not shown) formed by multiple interfaces (not shown) are formed to engage shroud 358 to closing sleeve 352.

Figure 4:
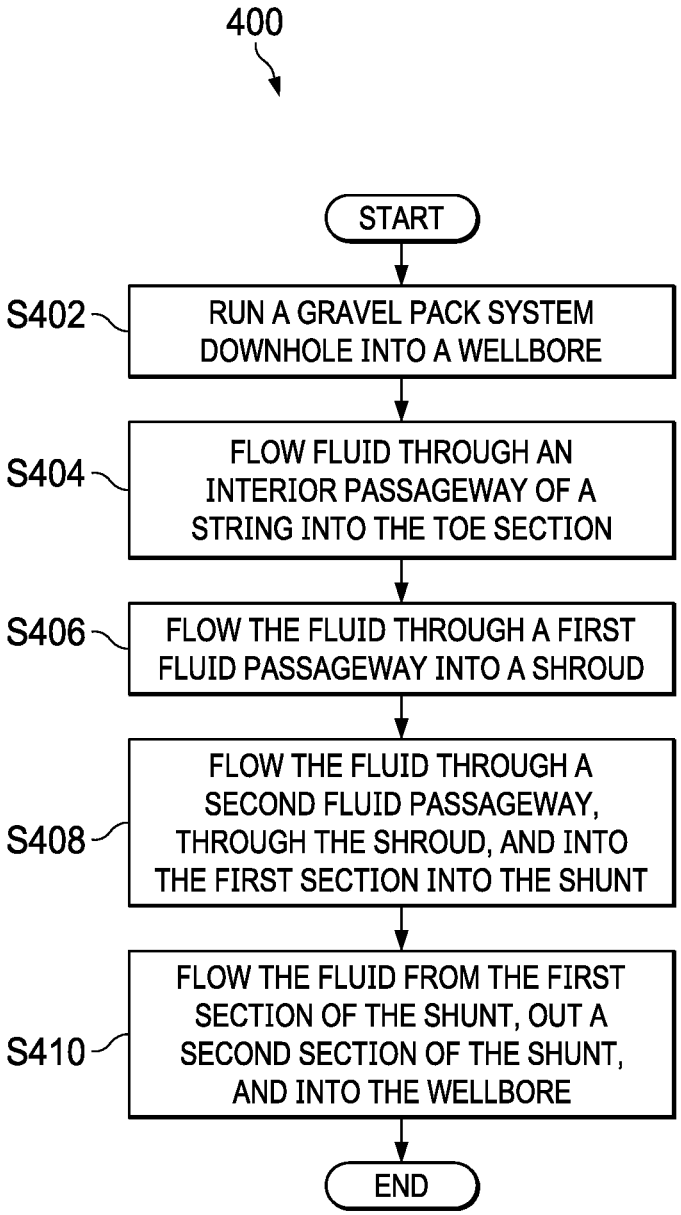
FIG. 4 is a flow chart of a process to flow fluid out of a gravel pack system.

FIG. 4 is a flow chart of a process 400 to flow fluid out of a gravel pack system. Although the operations in process 400 are shown in a particular sequence, certain operations may be performed in different sequences or at the same time where feasible.

At block S402, a gravel pack system is run downhole into a wellbore, such as wellbore 106 of FIG. 1. In that regard, FIG. 1 illustrates gravel pack system 120 deployed in wellbore 106 during a gravel packing operation. Further, FIG. 2 illustrates a similar gravel pack system 200 that is also deployable in wellbore 106 and having a closing sleeve 202, a shroud 208, and a shunt 210 positioned along a downhole string 116 such that fluids such as gravel slurry that are pumped through downhole string 116 flow from a toe section 203 of closing sleeve 202 along interior passageways formed by closing sleeve 202, shroud 208, shunt 210, and downhole string 116 to the heel section of closing sleeve 202, and from the heel section into nearby formation 112.

At block S404, the fluid flows through an interior passageway of a string into the toe section. FIG. 2 illustrates downhole string 116 having an interior passageway for fluid flow of gravel pack slurry and other types of fluids downhole, and eventually into toe section 203 of gravel pack system 200. At block S406, fluid flows through a first fluid passageway into a shroud. In that regard, FIG. 2 illustrates a first annulus 211 that provides a fluid passageway for fluid flow of gravel pack slurry and other types of fluids from toe section 203 into shroud 208. In some embodiments, the fluid flows out of the string or a tool coupled to the string, through a port, and into the first fluid passageway. In that regard, FIG. 2 also illustrates port 219 that provides a fluid passageway from downhole string 116 and/or tool 220, through port 219, and into first annulus 211.

At block S408, the fluid flows through a second fluid passageway, through the shroud, and into a first section into the shunt. FIG. 2 illustrates a second annulus 213 having a second interior passageway for fluid flow of gravel pack slurry and other types of fluids through second annulus 213, through shroud 208, and into first section 214 of shunt 210. At block S410, the fluid flows from the first section of the shunt, out a second section of the shunt, and into the wellbore. FIG. 2 illustrates shunt 210 providing a fluid passageway for fluid flow of gravel pack slurry and other types of fluids through shunt 210 from first section 214 of shunt, and through shunt 210. Moreover, the gravel pack slurry flows through second section 212 of shunt 210 before eventually flowing out of second section 212 (e.g., an exit port of second section 212) of shunt 210 and into formation 112 at the heel section. In some embodiments, where a screen is positioned near the second section of the shunt, the fluid also flows out of the second section of the shunt, through the screen, and into the wellbore. In that regard, FIG. 2 illustrates screen 216 positioned near second section 212 of shunt 210, and configured to filter materials having dimensions that are greater than a threshold dimension from flowing through screen 216 back into second section 212. In one or more of such embodiments, gravel pack slurry flows out of the second section of the shunt, through the screen, and into a wellbore annulus that is positioned between screen and the conveyance. In some embodiments, some fluid also flows through a flow control device, such as an ICD or AICD before flowing out of the gravel pack system. More particularly, fluid flows from second section 212 of the shunt 210, into nozzle 217, from nozzle 217 through screen 216, through flow control device 218, and into a wellbore annulus that is positioned between screen 216 and the conveyance.

Figure 5:
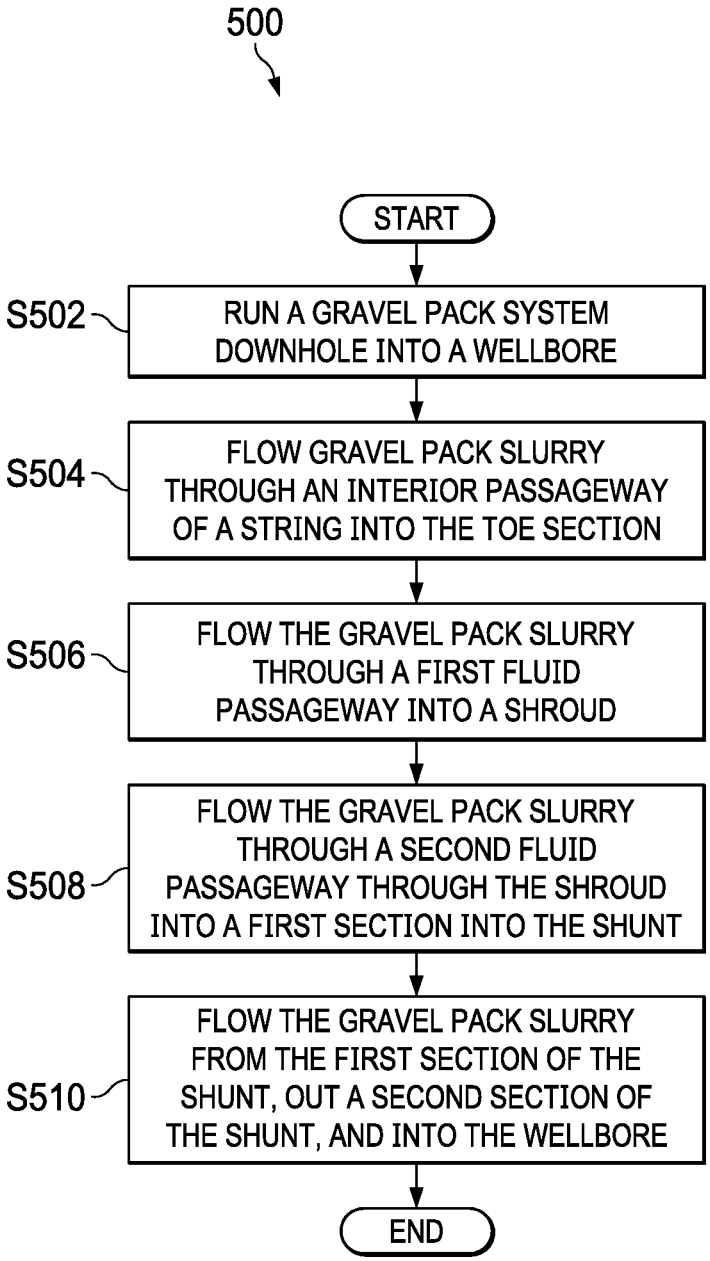
FIG. 5 is a flow chart of a process to provide fluid flow during a gravel packing operation.

FIG. 5 is a flow chart of a process 500 to provide fluid flow during a gravel packing operation. Although the operations in the process 500 are shown in a particular sequence, certain operations may be performed in different sequences or at the same time where feasible.

At block S502, a gravel pack system is run downhole into a wellbore, such as wellbore 106 of FIG. 1. At block S504, gravel pack slurry flows through an interior passageway of a string into the toe section. At block S506, the gravel pack slurry flows through a first fluid passageway into a shroud. At block S508, the gravel pack slurry flows through a second fluid passageway, through the shroud, and into a first section into the shunt. At block S510, the gravel pack slurry flows from the first section of the shunt, out a second section of the shunt, and into the wellbore. The operations performed at blocks S502, S504, S506, S508, and S510 are substantially similar or identical to the operations performed at blocks S402, S404, S406, S408, and S410, which are described in the paragraphs herein.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a gravel pack system, comprising: a heel section; a toe section that is downhole from the heel section; a conveyance having an interior passageway for fluid flow to the toe section; a closing sleeve positioned around an end of the conveyance, the closing sleeve and the conveyance forming an annulus that provides a first fluid passageway from the toe section towards the heel section; a shunt positioned around a first section of the conveyance, the shunt having a first section that provides a fluid flow entrance into the shunt, a second section that extends to the heel section along the gravel pack system, and one or more nozzles positioned along the second section and configured to provide fluid flow out of the gravel pack system; and a shroud having a first section that is coupled to the closing sleeve and a second section that is coupled to the shunt, the shroud being positioned around a second section of the conveyance that is between the closing sleeve and the shunt, the shroud and the conveyance forming a second annulus that provides a second fluid passageway from the first annulus to the entrance of the shunt.

Clause 2, the gravel pack system of clause 1, further comprising a port that provides a fluid passageway from the conveyance into the first annulus.

Clause 3, the gravel pack system of clauses 1 or 2, further comprising a screen positioned near the second section of the shunt and configured to filter materials from a fluid that flows out of the shunt and along the gravel pack system.

Clause 4, the gravel pack system of clause 3, further comprising an inflow control device that is configured to control fluid flow through the screen.

Clause 5, the gravel pack system of any of clauses 1-4, further comprising an autonomous inflow control device configured to control fluid flow through the screen.

Clause 6, the gravel pack system of any of clauses 1-5, wherein the shroud is a non-perforated shroud to prevent a fluid flowing through the second annulus to flow directly out of the gravel pack system.

Clause 7, the gravel pack system of any of clauses 1-6, wherein the closing sleeve comprises a seal bore that is positioned between the conveyance and the shroud.

Clause 8, the gravel pack system of any of clauses 1-7, further comprising an o-ring positioned between a section of the shroud and a section of the closing sleeve and configured to form a fluid seal that prevents fluid flow through the o-ring.

Clause 9, the gravel pack system of clause 8, further comprising a rachet formed from an interface of the section of the shroud and a corresponding interface of the section of the closing sleeve, wherein the rachet is configured to fixedly couple the first section of the shroud to the closing sleeve.

Clause 10, the gravel pack system of any of clauses 1-9, wherein the gravel pack system is deployed in an openhole wellbore.

Clause 11, a method to flow fluid out of a gravel pack system, comprising: running a gravel pack system downhole into a wellbore, the gravel pack system comprising: a heel section; a toe section that is downhole from the heel section; a conveyance having an interior passageway to the toe section; a closing sleeve positioned around an end of the conveyance, the closing sleeve and the conveyance forming an annulus that provides a first fluid passageway from the toe section towards the heel section; a shunt positioned around a first section of the conveyance, the shunt having a first section that provides a fluid flow entrance into the shunt, a second section that extends to the heel section along the gravel pack system, and one or more nozzles positioned along the second section and configured to provide fluid flow out of the gravel pack system; and a shroud having a first section that is coupled to the closing sleeve and a second section that is coupled to the shunt, the shroud being positioned around a second section of the conveyance that is between the closing sleeve and the shunt, the shroud and the conveyance forming a second annulus that provides a second fluid passageway from the first annulus to the entrance of the shunt; flowing fluid through the interior passageway of the conveyance into the toe section; flowing the fluid through the first fluid passageway into the shroud; flowing the fluid through the second fluid passageway through the shroud into the first section into the shunt; and flowing the fluid from the first section of the shunt, out the second section of the shunt, and into the wellbore.

Clause 12, the method of clause 11, wherein the gravel pack system further comprises a port that provides a fluid passageway from the conveyance into the first annulus, and wherein the method further comprises flowing the fluid from the conveyance through the port and into the first passageway.

Clause 13, the method of clauses 11 or 12, wherein the gravel pack system further comprises a screen positioned near the second section of the shunt and configured to filter materials from the fluid, and the method further comprising flowing the fluid out of the second section of the shunt, through the screen, and into a wellbore annulus that is positioned between the screen and the conveyance.

Clause 14, the method of clause 13, wherein the gravel pack system further comprises an inflow control device configured to control fluid flow through the nozzle, and the method further comprising flowing the fluid from the second section of the shunt, through the screen, through the inflow control device, and into the wellbore annulus.

Clause 15, the method of clauses 13 or 14, further comprising an autonomous inflow control device configured to control fluid flow through the nozzle, and the method further comprising flowing the fluid from the second section of the shunt, through the screen, through the autonomous inflow control device, and into the wellbore annulus.

Clause 16, a method to provide fluid flow during a gravel packing operation, comprising: running a gravel pack system downhole into a wellbore, the gravel pack system comprising: a heel section; a toe section that is downhole from the heel section; a conveyance having an interior passageway to the toe section; a closing sleeve positioned around an end of the conveyance, the closing sleeve and the conveyance forming an annulus that provides a first fluid passageway from the toe section towards the heel section; a shunt positioned around a first section of the conveyance, the shunt having a first section that provides a fluid flow entrance into the shunt, a second section that extends to the heel section along the gravel pack system, and one or more nozzles positioned along the second section and configured to provide fluid flow out of the gravel pack system; and a shroud having a first section that is coupled to the closing sleeve and a second section that is coupled to the shunt, the shroud being positioned around a second section of the conveyance that is between the closing sleeve and the shunt, the shroud and the conveyance forming a second annulus that provides a second fluid passageway from the first annulus to the entrance of the shunt; flowing a gravel pack slurry through the interior passageway of the conveyance into the toe section; flowing the gravel pack slurry through the first fluid passageway into the shroud; flowing the gravel pack slurry through the second fluid passageway through the shroud into the first section into the shunt; and flowing the gravel pack slurry from the first section of the shunt, out the second section of the shunt, and into the wellbore.

Clause 17, the method of clause 16, wherein the gravel pack system further comprises a port that provides a fluid passageway from the conveyance into the first annulus, and wherein the method further comprises flowing the gravel pack slurry from the conveyance through the port and into the first passageway.

Clause 18, the method of clauses 16 or 17, wherein the gravel pack system further comprises a screen positioned near the second section of the shunt and configured to filter materials from the gravel pack slurry, and the method further comprising flowing the gravel pack slurry out of the second section of the shunt, through the screen, and into a wellbore annulus that is positioned between the screen and the conveyance.

Clause 19, the method of clause 18, wherein the gravel pack system further comprises an inflow control device configured to control fluid flow through the nozzle, and the method further comprising flowing the gravel pack slurry from the first section of the shunt, through the second section of the shunt, through the screen, through the inflow control device, and into the wellbore annulus.

Clause 20, the method of clauses 18 or 19, further comprising an autonomous inflow control device configured to control fluid flow through the nozzle, and the method further comprising flowing the gravel pack slurry from the first section of the shunt, through the screen, through the autonomous inflow control device, and into the wellbore annulus.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A gravel pack system, comprising:

a heel section;

a toe section that is downhole from the heel section;

a conveyance having an interior passageway for fluid flow to the toe section;

a closing sleeve positioned around an end of the conveyance, the closing sleeve and the conveyance forming an annulus that provides a first fluid passageway from the toe section towards the heel section;

a shunt positioned around a first section of the conveyance, the shunt having a first section that provides a fluid flow entrance into the shunt, a second section that extends to the heel section along the gravel pack system, and one or more nozzles positioned along the second section and configured to provide fluid flow out of the gravel pack system; and a shroud having a first section that is coupled to the closing sleeve and a second section that is coupled to the shunt, the shroud being positioned around a second section of the conveyance that is between the closing sleeve and the shunt, the shroud and the conveyance forming a second annulus that provides a second fluid passageway from the first annulus to the entrance of the shunt.

2. The gravel pack system of claim 1, further comprising a port that provides a fluid passageway from the conveyance into the first annulus.

3. The gravel pack system of claim 1, further comprising a screen positioned near the second section of the shunt and configured to filter materials from a fluid that flows out of the shunt and along the gravel pack system.

4. The gravel pack system of claim 3, further comprising an inflow control device that is configured to control fluid flow through the screen.

5. The gravel pack system of claim 1, further comprising an autonomous inflow control device configured to control fluid flow through the screen.

6. The gravel pack system of claim 1, wherein the shroud is a non-perforated shroud to prevent a fluid flowing through the second annulus to flow directly out of the gravel pack system.

7. The gravel pack system of claim 1, wherein the closing sleeve comprises a seal bore that is positioned between the conveyance and the shroud.

8. The gravel pack system of claim 1, further comprising an o-ring positioned between a section of the shroud and a section of the closing sleeve and configured to form a fluid seal that prevents fluid flow through the o-ring.

9. The gravel pack system of claim 8, further comprising a rachet formed from an interface of the section of the shroud and a corresponding interface of the section of the closing sleeve, wherein the rachet is configured to fixedly couple the first section of the shroud to the closing sleeve.

10. The gravel pack system of claim 1, wherein the gravel pack system is deployed in an openhole wellbore.

11. A method to flow fluid out of a gravel pack system, comprising:

running a gravel pack system downhole into a wellbore, the gravel pack system comprising:

a heel section;

a toe section that is downhole from the heel section;

a conveyance having an interior passageway to the toe section;

a closing sleeve positioned around an end of the conveyance, the closing sleeve and the conveyance forming an annulus that provides a first fluid passageway from the toe section towards the heel section;

a shunt positioned around a first section of the conveyance, the shunt having a first section that provides a fluid flow entrance into the shunt, a second section that extends to the heel section along the gravel pack system, and one or more nozzles positioned along the second section and configured to provide fluid flow out of the gravel pack system; and a shroud having a first section that is coupled to the closing sleeve and a second section that is coupled to the shunt, the shroud being positioned around a second section of the conveyance that is between the closing sleeve and the shunt, the shroud and the conveyance forming a second annulus that provides a second fluid passageway from the first annulus to the entrance of the shunt;

flowing fluid through the interior passageway of the conveyance into the toe section;

flowing the fluid through the first fluid passageway into the shroud;

flowing the fluid through the second fluid passageway through the shroud into the first section into the shunt; and flowing the fluid from the first section of the shunt, out the second section of the shunt, and into the wellbore.

12. The method of claim 11, wherein the gravel pack system further comprises a port that provides a fluid passageway from the conveyance into the first annulus, and wherein the method further comprises flowing the fluid from the conveyance through the port and into the first passageway.

13. The method of claim 11, wherein the gravel pack system further comprises a screen positioned near the second section of the shunt and configured to filter materials from the fluid, and the method further comprising flowing the fluid out of the second section of the shunt, through the screen, and into a wellbore annulus that is positioned between the screen and the conveyance.

14. The method of claim 13, wherein the gravel pack system further comprises an inflow control device configured to control fluid flow through the nozzle, and the method further comprising flowing the fluid from the second section of the shunt, through the screen, through the inflow control device, and into the wellbore annulus.

15. The method of claim 13, further comprising an autonomous inflow control device configured to control fluid flow through the nozzle, and the method further comprising flowing the fluid from the second section of the shunt, through the screen, through the autonomous inflow control device, and into the wellbore annulus.

16. A method to provide fluid flow during a gravel packing operation, comprising:

running a gravel pack system downhole into a wellbore, the gravel pack system comprising:

a heel section;

a toe section that is downhole from the heel section;

a conveyance having an interior passageway to the toe section;

a closing sleeve positioned around an end of the conveyance, the closing sleeve and the conveyance forming an annulus that provides a first fluid passageway from the toe section towards the heel section;

a shunt positioned around a first section of the conveyance, the shunt having a first section that provides a fluid flow entrance into the shunt, a second section that extends to the heel section along the gravel pack system, and one or more nozzles positioned along the second section and configured to provide fluid flow out of the gravel pack system; and a shroud having a first section that is coupled to the closing sleeve and a second section that is coupled to the shunt, the shroud being positioned around a second section of the conveyance that is between the closing sleeve and the shunt, the shroud and the conveyance forming a second annulus that provides a second fluid passageway from the first annulus to the entrance of the shunt;

flowing a gravel pack slurry through the interior passageway of the conveyance into the toe section;

flowing the gravel pack slurry through the first fluid passageway into the shroud;

flowing the gravel pack slurry through the second fluid passageway through the shroud into the first section into the shunt; and flowing the gravel pack slurry from the first section of the shunt, out the second section of the shunt, and into the wellbore.

17. The method of claim 16, wherein the gravel pack system further comprises a port that provides a fluid passageway from the conveyance into the first annulus, and wherein the method further comprises flowing the gravel pack slurry from the conveyance through the port and into the first passageway.

18. The method of claim 16, wherein the gravel pack system further comprises a screen positioned near the second section of the shunt and configured to filter materials from the gravel pack slurry, and the method further comprising flowing the gravel pack slurry out of the second section of the shunt, through the screen, and into a wellbore annulus that is positioned between the screen and the conveyance.

19. The method of claim 18, wherein the gravel pack system further comprises an inflow control device configured to control fluid flow through the nozzle, and the method further comprising flowing the gravel pack slurry from the first section of the shunt, through the second section of the shunt, through the screen, through the inflow control device, and into the wellbore annulus.

20. The method of claim 18, further comprising an autonomous inflow control device configured to control fluid flow through the nozzle, and the method further comprising flowing the gravel pack slurry from the first section of the shunt, through the screen, through the autonomous inflow control device, and into the wellbore annulus.

* * * * *